United States Patent [19]

Markoff

[11] Patent Number: 4,710,983

[45] Date of Patent: Dec. 8, 1987

[54] COMBINATION HANDBAG AND DRESS ACCESSORY ITEM

[76] Inventor: Bradley S. Markoff, 4912 Libbit Ave., Encino, Calif. 91436

[21] Appl. No.: 30,343

[22] Filed: Mar. 26, 1987

[51] Int. Cl.[4] ..... A41F 19/00

[52] U.S. Cl. ..... 2/301

[58] Field of Search ..... 2/301, 300, 338, 311; 150/100

[56] References Cited

U.S. PATENT DOCUMENTS 709,595 5/1905 Scott ..... 2/300

2,976,541 3/1961 Williams et al. ..... 2/300

*Primary Examiner*—Doris L. Troutman

*Attorney, Agent, or Firm*—Philip D. Junkins

[57] ABSTRACT

A dress accessory item such as a belt, waistband, strap or sash convertible into a handbag or purse. The belt-like dress accessory item includes first and second courses of decorative fastener devices, each originating from a common point on the periphery of the accssory item and affixed to and extending in opposite directions around the peripheral edge portion thereof. The first course of fastener devices being cooperable with the second course of fastener devices for joining the peripheral edge portion of the accessory item together upon itself commencing initially at the common point and successively thereafter along the length of the fastener courses to form a handbag or purse. The courses of fastener devices may be mating halves of a zipper, mating lines of male and female snap fastener components, and mating hook strip and eye strip portions of a Velcro connector.

10 Claims, 10 Drawing Figures

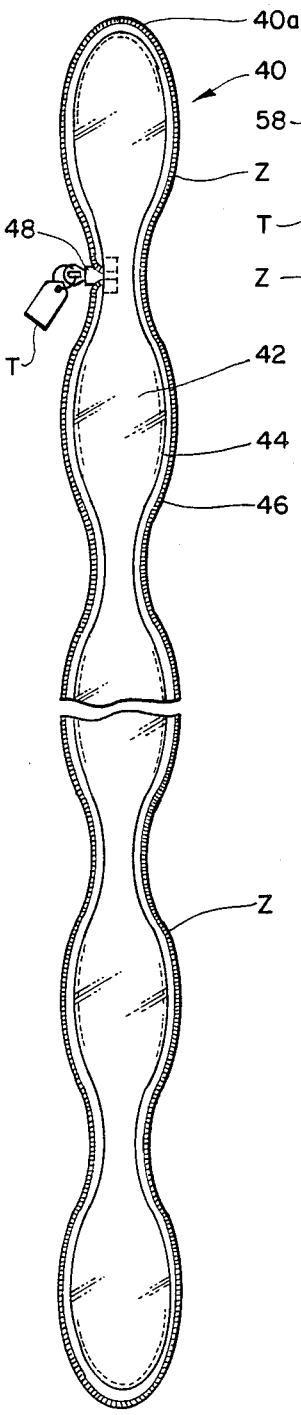
FIG.7.
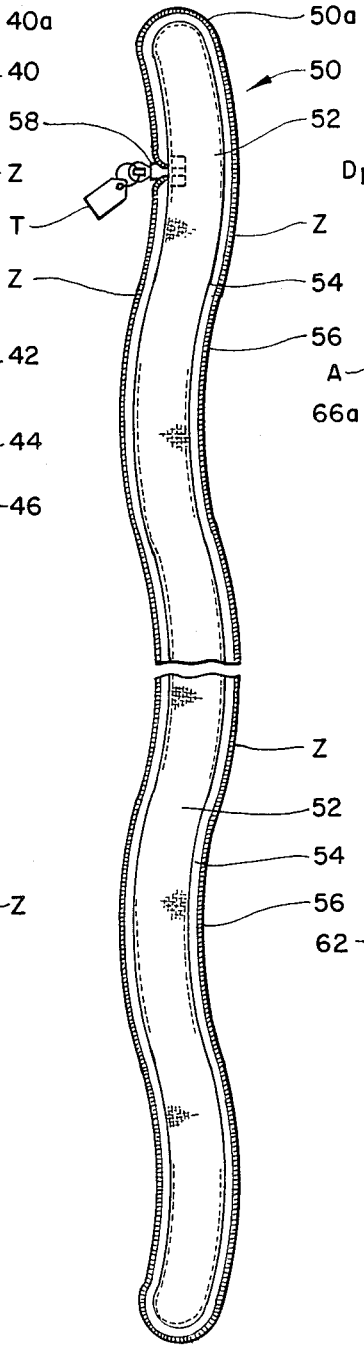
FIG.8.
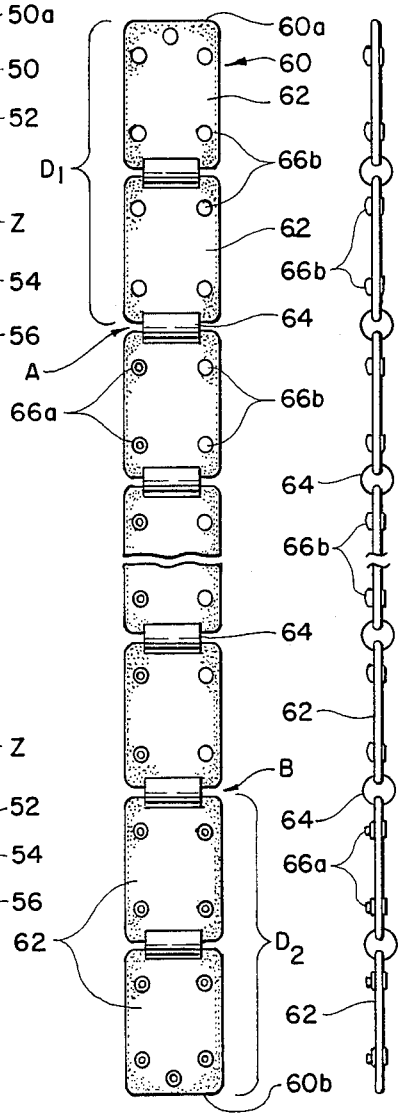
FIG.9.
FIG.10.

COMBINATION HANDBAG AND DRESS ACCESSORY ITEM

BACKGROUND OF THE INVENTION

This invention relates to fashion handbags and dress accessory items including belts and sashes. More particularly, the invention relates to fashionable belts, waistbands, straps and sashes which are uniquely convertible into sporty handbags and purses.

Young and older women, alike, are attracted to new and unique fashion items associated with their mode or style of dress and the activities in which they participate. Women's belts and purses are particularly utilized as fashion accessory items as-well-as items of high utility. Belts and purses or handbags are made of a multitude of generally flexible materials including leather, imitation leather, cloth and plastic materials and are shaped and color-decorated in countless ways.

It is a principal object of the present invention to provide unique dress accessory items which are convertible from a belt or sash form to a purse or handbag form.

It is another object of the invention to provide unique dress accessory items which are convertible from a handbag or purse form to a belt or sash form.

It is a further object of the invention to provide unique and fashionable dress accessory items which may take the form of a belt, waistband, strap or sash or the form of a purse, handbag or pouch.

It is yet another object of the invention to provide unique and fashionable belts, waistbands, straps, sashes, purses and handbags made of a wide variety of generally flexible materials and which are convertible from one distinct dress accessory form to another distinct dress accessory form.

Other objects and advantages of the present invention will be apparent from the following summary and detailed description of the invention, taken with the accompanying drawing figures.

SUMMARY OF THE INVENTION

The present invention relates to fashionable belts, waistbands, straps and sashes, as one form of a woman's dress accessory item, which are readily and uniquely convertible into sporty handbags, purses and pouches (and vice versa), as another form of dress accessory item. In its basic form, the convertible dress accessory items of the invention comprise elongated flexible belts or straps of fabric, leather, imitation leather or plastic material (or combinations of such materials) which have positioned around (and attached thereto) their peripheries fastener means including any of a variety of plastic and metallic zippers, snap fasteners, Velcro type hook and eye fabric connector strips, etc. In accordance with the invention, it has been found that if the mating sides of a zipper, male and female components of snap fasteners or mating hook and eye strips of Velcro connectors, are oriented oppositely around a belt or strap periphery and zipped, snapped or connected together, respectively, there is formed a unique bag, pouch or container. The basic elongated belt, waistband, strap or sash may take a number of forms including that of: a common uniform-width belt; a waistband of variable width; or a multiple-piece, hinged strap with the result that the bag, pouch or container formed from such belt, waistband or strap (via its respective peripheral fastener system) takes a number of unique circular, toroidal or rectangular forms.

The belt or waistband form of the convertible accessory item of the invention can be of various lengths, i.e. one to two or more body circumference lengths, and may be adorned in any desired fashion. As one possible belt-bag convertible accessory item, the belt may be made of a principal length of clear flexible plastic sheet material of uniform width and suitable strength with brightly colored zipper halves stiched oppositely around the periphery thereof. When it is desired to utilize the belt to form a handbag or utility purse, the zipper is closed over its full length (or near full length) and the bag or purse that is created is of unique semi-toroidal form with a spiral contrast of colored areas and transparent plastic areas. Such a utility purse might be utilized to carry a bathing suit (of like contrasting color) to beach or pool facilities with the utility purse in its un-zippered form yielding a fashion belt or sash for wear with the bathing suit. After bathing, the belt or sash is returned to its utility purse configuration and the wet bathing suit may be carried therein.

BRIEF DESCRIPTION OF THE DRAWING FIGURES

The invention is illustrated in the accompanying drawing figures in which:

FIG. 7 is a longitudinal top or flat-surface view of a fashion sash of variable width with a peripheral zipper in accordance with the inventiion;

FIG. 8 is a longitudinal top or flat-surface view of an alternative form of fashion belt or sash with a peripheral zipper;

FIG. 9 is a longitudinal top or flat-surface view of a fashion belt formed of a multiplicity of flexible belt units, hinged one to another, with a line of female snap fastener parts spaced uniformly around one half of the belt periphery and a line of male snap fastener parts spaced uniformly around the other half of the belt periphery; and FIG. 10 is a partial edge view of the fashion belt of FIG. 9.

DETAILED DESCRIPTION OF THE INVENTION

Figures 1, 6:
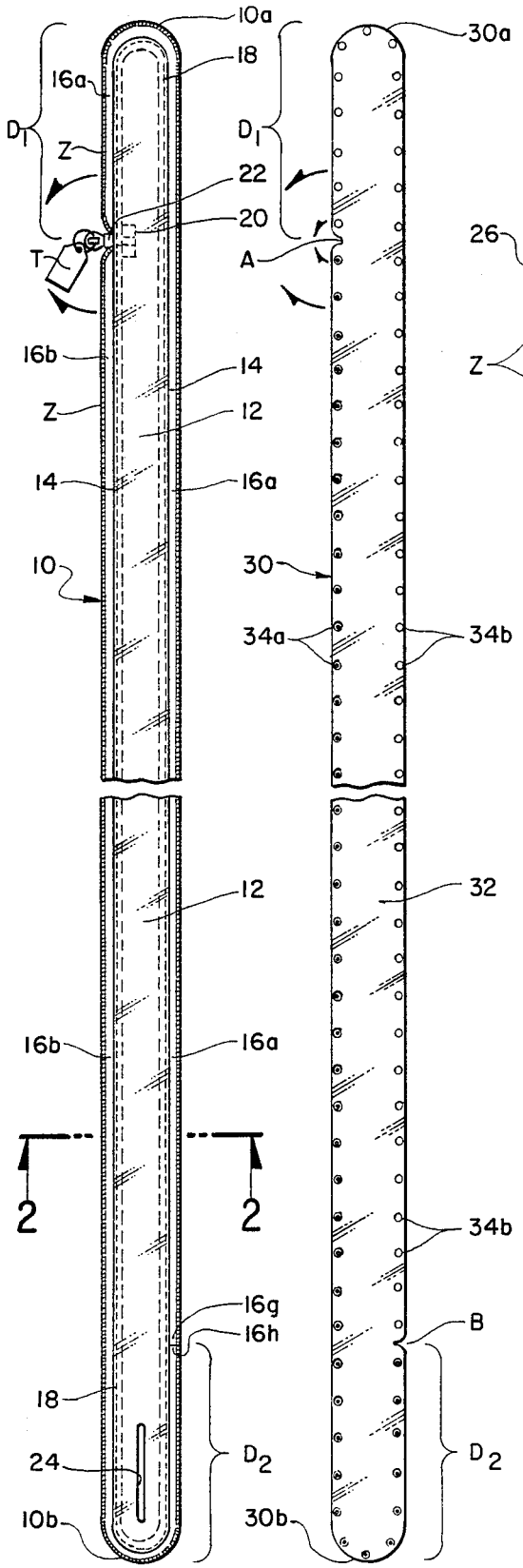
FIG. 1 is a longitudinal top or flat-surface view of a fashion belt with zipper halves stitched oppositely and peripherally around the belt in accordance with the invention.
FIG. 6 is a longitudinal top or flat-surface view of a fashion belt of the invention with a line of female snap fastener parts spaced uniformly around one half of the belt periphery and a line of male snap fastener parts spaced uniformly around the other half of the belt periphery.
Figure 2:
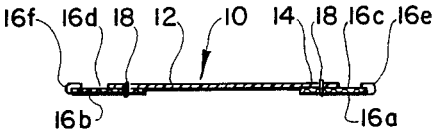
FIG. 2 is a cross section view of the zipperable fashion belt of FIG. 1 taken along line 2—2 of such figure.
Figure 5:
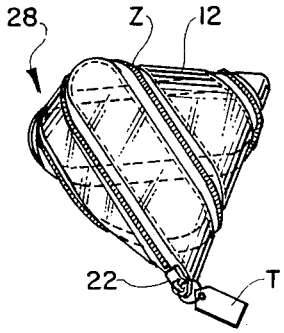
FIG. 5 is a top view of the finished purse or handbag of FIG. 4.

A first embodiment of the convertible handbag and dress accessory item of the invention is shown in FIGS. 1–5 on the drawing sheets. The dress accessory item as shown in FIGS. 1 and 2 is a belt 10 comprised of a central and principal elongated strip or panel of clear flexible plastic material 12. At the peripheral edge portion 14 of strip 12 there is affixed oppositely oriented open halves 16*a* and 16*b* of a zipper Z. The zipper halves 16*a* and 16*b* (including, respectively, tape portions 16*c* and 16*d* and teeth 16*e* and 16*f*) may be affixed to belt strip 12 by stitches 18 with the starting end 20 of the zipper and zipper pull-closure member 22 located on one side of the strip 12 at an appropriate distance $D_1$ from the end 10*a* of belt 10 (as specified hereinafter). The zipper halves 16*a* and 16*b* extend oppositely around the periphery of belt strip 12 and terminate at their abutting terminal ends 16*g* and 16*h*, respectively, located on the other side of the strip 12 at an appropriate distance $D_2$ from the end 10*b* of belt 10. The distance $D_1$ for the location of the starting end 20 of the zipper dictates the magnitude of the principal dimension of the handbag or purse to be formed by the belt 10 in accordance with the invention. The distance $D_2$ for the location of the abutting terminal ends 16*g* and 16*h* of zipper halves 16*a* and 16*b*, respectively, (with respect to belt end 10*b*) is equal to distance $D_1$.

Figure 3:
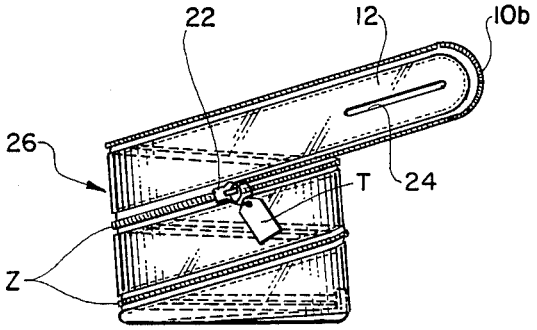
FIG. 3 is a front view of a fashion purse in the process of construction from the zipperable belt of FIG. 1.
Figure 4:
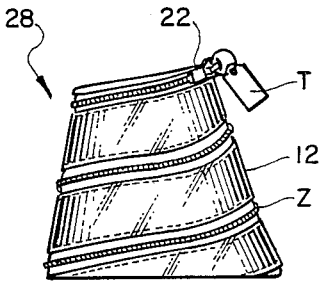
FIG. 4 is a front view of a completed purse or handbag constructed from the belt of FIG. 1 in accordance with the invention.

Although the overall length of belt 10 is dictated principally by the desired length of such dress accessory in its utilitarian function as a belt, it is also desirable that (for the purpose of its conversion into a handbag or purse) such overall belt length be substantially equal to four or more multiples of the distance $D_1$ for the location of the starting end 20 of the zipper Z. The overall length of belt 10 is also dictated by the length of the zipper halves 16*a* and 16*b*. As shown in FIGS. 1 and 3, the belt 10 may include at one of its ends a slot opening 24 through which the opposite end of the belt may be inserted for belt-fastening purposes. A name tag T or other decorative item may be affixed to the zipper pull-closure member 22.

It is to be noted that, although the zipper Z of the belt 10 is comprised of zipper halves 16*a* and 16*b*, the zipper Z may be comprised of a single loop of zipper tooth-mounting tape whereby there are no terminal zipper ends to be abutted at a distance $D_2$ from belt end 10*b*. The circumferential measurement of such a zipper loop results in a belt length of slightly less than one-half of such measurement. The starting end of such a zipper must still be located at a distance $D_1$ from end 10*a* of the belt 10 so as to result in the creation of a handbag or purse upon closure of the zipper.

As the zipper pull-closure member 22 is moved to close the zipper halves 16*a* and 16*b*, a unique purse-like container 26 (see FIG. 3) begins to form. Upon completion of the zipping action a finished purse or handbag 28 of distinctive shape is created (see FIGS. 4 and 5). Access to such handbag may be obtained by back-zipping the zipper pull-closure member 22. The finished purse or handbag 28 has a toroidal shape and appearance and, although the transparency of belt strip 12 provides visual access to the inside of the handbag, the closed zipper Z provides a sporty contrasting color spiral effect to the item. It is to be understood that the belt strip 12 need not be of a transparent plastic material (such as sheet vinyl), but may be comprised of: a colored fabric material of tight or loose weave, leather, imitation leather or any of numerous other materials. The zipper Z may be of any of the well known metallic or plastic tooth types or of pastic spiral wire construction.

Referring now to FIG. 6, there is shown an alternative embodiment of the present invention. The dress accessory item shown in such figure again consists of a fashion belt 30. The belt 30 is comprised of an elongated strip or panel of clear flexible plastic material 32. At the peripheral edge portion of strip 32 there is affixed two oppositely oriented courses of uniformly spaced male and female components 34*a* and 34*b*, respectively, of snap fasteners of known type. The course of male snap fastener components 34*a* extends from indentation point A at a distance $D_1$ on one side of belt strip 32 from belt end 30*a* peripherally counter-clockwise to indentation point B on the other side of strip 32 at a distance $D_2$ from belt end 30*b*. The course of female snap fastener components 34*b* extends from indentation point A on belt strip 32 clockwise to indentation point B on such strip. The distance $D_1$ for the location of indentation point A dictates the magnitude of the principal dimension of the handbag or purse to be formed by the belt 30 in accordance with the invention. The distance $D_2$ for the location of indentation point B from belt end 30*b* is equal to distance $D_1$.

To convert the belt accessory item 30 of FIG. 6 into a handbag or purse, the male and female snap fastener components 34a and 34*b* immediately adjacent indentation point A are snapped together and thereafter (in sequence) each subsequent pair of male and female snap fastener components are snapped together whereby a purse-like container or pouch begins to form as in the case of the closure of zipper halves as shown in FIG. 3. Upon completion of the snap connection of the male and female fastener components a finished purse or handbag of distinctive shape is created. Access to such handbag may be obtained by un-snapping several of the last snapped male and female snap fastener components. As in the case of the belt accessory item 10 of FIGS. 1 and 2 the belt 30 of FIG. 6 need not be composed of a transparent plastic material strip, but may be comprised of any flexible fabric or sheet material.

In replacement of oppositely oriented courses of male and female snap fastener components affixed at the peripheral edge portion of belt strip 32, there may be substituted affixed mating hook and eye strips of Velcro type connectors. Thus, a Velcro hook strip may extend from indentation point A on one side of the belt strip 32 peripherally and counter-clockwise to indentation point B on the other side of strip 32 and a Velcro eye strip may extend from indentation point A on the belt strip 32 peripherally and clockwise to indentation point B on the other side of such strip. To convert such a belt accessory item into a handbag or purse, the VELCRO hook and eye strips immediately adjacent indentation point A are interfaced together for peripheral connection and thereafter the remaining sequential portions of such hook and eye strips are interfaced in succession whereby a purse-like container or pouch begins to be formed. Upon completion of the interface connection between the peripherally affixed Velcro hook and eye strips a finished purse or handbag of distinctive shape is created.

In FIGS. 7–9 additional forms of belt or waistband type accessory items are shown. Each of such items, because of the peripheral fastener system associated with the basic belt or waistband structure, can be converted into a unique handbag or purse. Thus, in FIG. 7 there is shown a waistband 40 comprised of a strip of flexible material 42 of varying width and a zipper Z formed of a loop of zipper tape 44 (with zipper teeth 46) appropriately affixed to the periphery of strip 42. A zipper pull-closure member 48 is shown at its starting point located on one side of the strip 42 of waistband 40 and spaced at an appropriate distance from the end 40*a* of such waistband. Because of the varying width of strip material 42, upon closure of the loop of zipper tape 44 by pull-closure member 48, the resulting handbag or purse has a unique undulated toroidal configuration. A name tag T or other decorative item may be affixed to the zipper pull-closure member 48.

In FIG. 8 there is presented another form of waistband 50 comprised of a strip of flexible material 52 of substantially uniform width but of wave configuration. A zipper Z formed of a loop of zipper tape 54 (with zipper teeth 56) is appropriately affixed to the periphery of strip 52. A zipper pull-closure member 58 is shown at its starting point located on one side of the strip 52 and spaced at an appropriate distance from the end 50*a* of such waistband. As with the waistband 40 of FIG. 7, the wave configuration of strip 52, upon closure of the loop of zipper tape 54 by pull-closure member 58, the resulting handbag or purse has a unique configuration.

A further form of a belt-type dress accessory 60, in accordance with the invention, is shown in FIGS. 9 and 10. Such belt-type accessory is comprised of a series of like belt components 62 (fabric material, leather, etc.) which are interconnected by loop hinge members 64. At the peripheral edge portion of accessory 60 there are affixed two oppositely oriented courses of uniformly spaced male and female components 66*a* and 66*b*, respectively, of snap fasteners of known type. The course of male snap fastener components 66*a* extends from an indentation or belt component separation point A at a distance $D_1$ on one side of belt-type accessory 60 from end 60*a* peripherally counterclockwise to indentation or belt component separation point B on the other side of belt-type accessory 60 at a distance $D_2$ from end 60*b*. The course of female snap fastener components 66*b* extends from point A on accessory 60 peripherally clockwise to point B on the periphery of such accessory. The distance $D_2$ for the location of point B from accessory end 60*b* is equal to distance $D_1$. To convert the belt-type dress accessory item 60 of FIGS. 9 and 10 into a fashion handbag or purse, the male and female snap fastener components 66*a* and 66*b* immediately adjacent indentation point A are snapped together and thereafter (in sequence) each subsequent pair of male and female snap fastener components are snapped together whereby a purse-like container or pouch is formed. Access to such purse-like container may be obtained by un-snapping several of the last snapped male and female snap fastener components.

In the specification and drawing figures there has been set forth preferred embodiments of the combination handbag and belt-like dress accessory item of the invention and although specific terms have been employed in describing the invention, they are used in a generic and descriptive sense only and not for purposes of limitation, the scope of the invention being defined in the following claims.

What is claimed is:

1. A dress accessory item convertible into a handbag comprising: an elongated flexible belt-like dress accessory item; and first and second courses of decorative fastener means each originating from a common point on the periphery of said belt-like accessory item and affixed to and extending in opposite directions around the peripheral edge portion of said accessory item, said first course of fastener means cooperable with said second course of fastener means for joining said peripheral edge portion of said accessory item together upon itself commencing initially at said common point and successively thereafter along the length of said courses of fastener means to form thereby a handbag.

2. A dress accessory item convertible into a handbag as claimed in claim 1 wherein the common point of origination of the first and second courses of decorative fastener means on the periphery of said belt-like accessory item is located on one side edge portion of said accessory item at a point removed from a first end of said item.

3. A dress accessory item convertible onto a handbag as claimed in claim 2 wherein the distance between the common point of origination of said fastener means on the periphery of said belt-like accessory item and the first end of said item establishes the principal dimension of said handbag and the distance between said common point and said second end of said item is at least twice the distance between said common point and the first end of said item.

4. A dress accessory item convertible into a handbag as claimed in claim 2 wherein the distance between the common point of origination of said fastener means on the periphery of said belt-like accessory item and the first end of said item establishes the principal longitudinal dimension of said handbag and the distance between said common point and said second end of said item is at least four times the distance between said common point and the first end of said item.

5. A dress accessory item convertible into a handbag as claimed in claim 2 wherein the first and second courses of decorative fastener means are of equal length and extend oppositely around the peripheral edge portion of said belt-like accessory item to a terminal point at which said courses of fastener means end in abutment to each other

6. A dress accessory item convertible into a handbag as claimed in claim 1 wherein the first and second courses of decorative fastener means comprise the mating halves of a zipper and said zipper halves are provided with a zipper pull-closure member.

7. A dress accessory item convertible into a handbag as claimed in claim 1 wherein the first and second courses of decorative fastener means comprise the mating hook strip portion and eye strip portion of a Velcro type connector.

8. A dress accessory item convertible into a handbag as claimed in claim 1 wherein the first and second courses of decorative fastener means comprise a line of equally spaced male snap fastener components and a mating line of equally spaced female snap fastener components.

9. A dress accessory item convertible into a handbag as claimed in claim 1 wherein the first and second courses of decorative fastener means comprise an endless tape loop bearing zipper teeth and said fastener means is provided with a zipper pull-closure member.

10. A dress accessory item convertible into a handbag as claimed in claim 1 wherein the elongated flexible belt-like dress accessory item comprises an accessory item selected from the group consisting of belts, waistbands, straps and sashes.

* * * * *